US005994277A

United States Patent [19]

Ritchie et al.

[11] Patent Number: 5,994,277

[45] Date of Patent: Nov. 30, 1999

[54] LUBRICATING COMPOSITIONS WITH IMPROVED ANTIOXIDANCY COMPRISING ADDED COPPER, A MOLYBDENUM CONTAINING COMPOUND, AROMATIC AMINE AND ZDDP

[75] Inventors: Andrew J. D. Ritchie, Chatham; Harold Shaub, Berkeley Heights, both of N.J.; Ian P. Field, Abingdon, United Kingdom

[73] Assignee: Exxon Chemical Patents, Inc., Linden, N.J.

[21] Appl. No.: 08/625,686

[22] Filed: Apr. 3, 1996

Related U.S. Application Data

[63] Continuation of application No. 08/411,064, Mar. 27, 1995, abandoned, which is a continuation of application No. 08/120,259, Sep. 13, 1993, abandoned.

[51] Int. Cl.[6] ..... C10M 141/06; C10M 141/10

[52] U.S. Cl. ..... 508/365; 508/375; 508/527; 508/539; 508/563

[58] Field of Search ..... 508/365, 375, 508/527, 539, 563

[56] References Cited

U.S. PATENT DOCUMENTS

| | | | |
|---|---|---|---|
| 2,343,756 | 3/1944 | Downing et al. | 252/37.2 |
| 3,541,014 | 11/1970 | LeSuer | 252/37.2 |
| 3,598,847 | 8/1971 | Larson | 252/37.2 |
| 3,691,073 | 9/1972 | Larson | 252/37.2 |
| 4,469,609 | 9/1984 | Bandlish et al. | 252/37.2 |
| 4,501,677 | 2/1985 | Habeeb | 252/37.2 |
| 4,664,822 | 5/1987 | Hunt et al. | 252/32.7 |
| 4,705,641 | 11/1987 | Goldblatt et al. | 252/35 |
| 4,966,719 | 10/1990 | Coyle et al. | 252/42.7 |
| 4,995,996 | 2/1991 | Coyle et al. | 252/42.7 |
| 5,650,381 | 7/1997 | Gatto et al. | 508/364 |
| 5,786,307 | 7/1998 | Igarashi et al. | 508/365 |

FOREIGN PATENT DOCUMENTS

| | | |
|---|---|---|
| 024146 | 2/1981 | European Pat. Off. . |
| 205165 | 12/1986 | European Pat. Off. . |
| 280579 | 8/1988 | European Pat. Off. . |
| 280580 | 8/1988 | European Pat. Off. . |
| 384720 | 8/1990 | European Pat. Off. . |
| 2097422 | 3/1982 | United Kingdom . |
| 2220954 | 1/1990 | United Kingdom . |

OTHER PUBLICATIONS

PCT Search Report dated Jan. 2, 1995.

*Primary Examiner*—Jerry D. Johnson
*Attorney, Agent, or Firm*—Ohlandt, Greeley, Ruggiero & Perle

[57] ABSTRACT

Crankcase lubricant compositions for use in automobile or truck engines comprise a major amount of a lubricating oil, added copper present in oil-soluble form, at least 2 ppm of molybdenum present in oil-soluble form, and a total of from 0.05 to 2 mass % of one or more oil-soluble aromatic amines. The specified additives provide a highly effective antioxidant system.

16 Claims, No Drawings

LUBRICATING COMPOSITIONS WITH IMPROVED ANTIOXIDANCY COMPRISING ADDED COPPER, A MOLYBDENUM CONTAINING COMPOUND, AROMATIC AMINE AND ZDDP

This is a continuation of application Ser. No. 08/411,064, filed Mar. 27, 1995 now abandoned which is a continuation of 08/120,259, filed Sep. 13, 1993 now abandoned.

FIELD OF THE INVENTION

The present invention relates to lubricating compositions, especially crankcase lubricants for automobiles and trucks. More particularly it relates to a composition and method for improving the antioxidancy of crankcase lubricants.

BACKGROUND OF THE INVENTION

Limited oil resources and rapidly increasing crude oil prices have created a need for lubricants with longer useful lives. Also, longer intervals between crankcase oil changes will reduce the volume of used oil for disposal. For these and other reasons, the efficiency and useful lives of oil-based lubricants, particularly crankcase lubricants, must be improved.

Oxidation of the oil component in the lubricant substantially shortens its useful life. Oxidation yields corrosive acids and an undesirable increase in viscosity. While high quality basestocks tend to be relatively resistant to oxidation, contaminants (e.g., iron) and common additives can greatly accelerate oxidation. Inclusion of detergents (e.g. calcium or magnesium detergents) and dispersants (e.g. polyamine or polyester derivatives of alkenyl succinic acids or anhydrides) is desirable for oil performance, but these additives accelerate oxidation to such an extent that oxidation is a major cause of reduced useful life.

With depletion of high quality basestock oil reserves, resort to lower quality basestocks has become necessary. These lower quality basestocks have a greater tendency to oxidize than do higher quality basestocks.

If the life of a crankcase lubricant is to be maximized, oxidation must be minimized. Over the years various oxidation inhibitors, or antioxidants, have been proposed. Examples of antioxidants which have been proposed for use in crankcase lubricants include zinc dihydrocarbyl dithiophosphates which are primarily used as antiwear agents but also act as antioxidants, aromatic amines (e.g. alkylated phenylamines and phenyl-α-naphthylamines), hindered phenols, alkaline earth metal salts or sulfurized alkyl phenols in which the alkyl groups have 5 to 12 carbon atoms (e.g., calcium nonylphenyl sulfide and barium octylphenyl sulfide), phosphosulfurized or sulfurized hydrocarbons, and oil soluble copper compounds.

Some of the above mentioned antioxidants are very effective. Thus, European Patent No. 24 146 B teaches lubricating compositions comprising a major amount of lubricating oil, from 1 to 10 wt % of certain ashless dispersants or from 0.3 to 10 wt % of certain nitrogen- or ester- containing polymeric viscosity index improver dispersants, or mixtures of dispersants and viscosity index improver dispersants; 0.01 to 5 wt % of zinc dihydrocarbyl dithiophosphate (ZDDP); and 5 to 500 parts per million (ppm) by weight of added copper in the form of oil-soluble copper compound. The patent notes that the inexpensive copper antioxidants are effective at low concentrations and therefore do not add much to the products cost. In the amounts employed, the copper compounds do not interfere with the performance of other components of the lubricating system. In many instances, completely satisfactory results are obtained when the copper compound is the sole antioxidant in addition to ZDDP. Alternatively, the patent teaches that for particularly severe conditions where a supplementary antioxidant may be desirable, the amount of supplementary antioxidant required is small, often far less than the amount required in the absence of the copper compound. Supplementary antioxidants mentioned include phenols, hindered phenols, bis-phenols, sulfurized phenols, catechol, alkylated catechols, sulfurized alkyl catechols, diphenylamine, alkylated diphenylamines, phenyl-l-naphthylamine and its alkylated derivatives, alkyl borates, aryl borates, alkyl phosphates, aryl phosphites, aryl phosphates, O,O,S-trialkyl dithiophosphates, O,O,S-triaryl dithiophosphates, and O,O,S-trisubstituted dithiophosphates containing both alkyl and aryl groups.

A specific copper-containing lubricant described in U.S. Pat. No. 4,705,641 comprises (A) a basestock and (3) a copper salt and a molybdenum salt wherein the total concentration of the copper and molybdenum metal or metal ions in solution ranges between about 0.006 and about 0.5 wt % of the basestock (60 to 5000 ppm by weight). The stated preferred concentration of copper and molybdenum ranges from about 0.009 to about 0.1 wt % of the basestock (90 to 1000 ppm by weight).

EP 280,579 A and EP 280,580 A each mention in comparative Example 4 lubricating compositions containing copper oleate and molybdenum oleate.

Despite the beneficial effect of using soluble copper described in EP 24,146 B, the antioxidant literature contains many suggestions that copper should be avoided. For example, an antioxidant system comprising in association (a) a particular sulfur-containing molybdenum complex and (b) an aromatic amine is described in UK patent 2,097,422. The recited sulfur containing molybdenum complex is prepared by reacting an acidic molybdenum compound with a basic nitrogen-containing substance and a sulfur source. Preferably the reaction is carried out in the presence of a polar promoter. Example 10 describes a test for oxidation stability wherein copper is used as an oxidation catalyst.

Another patent teaching that copper is an oxidation catalyst is EP 404,650 A. That application discloses oil-soluble overbased additives comprising an alkali or alkaline earth metal carbonate in combination with a substantially hydrocarbon insoluble organic molybdenum derivative. The application states that the molybdenum derivative is solubilized during the overbasing reaction, perhaps by incorporating the derivative into the micelles of the metal carbonate colloid. The molybdenum complex may be a molybdenum-amine complex formed by reacting an acidic molybdenum compound with an amine, e.g. a primary aliphatic amine. Also taught are oxygen containing molybdenum complexes formed by reacting a molybdenum compound with an oxygen containing compound, e.g. a glycol. Example 16 describes a TFOUT (thin film oxygen uptake test) using a naphthenate of lead, copper, iron, manganese and tin as catalyst.

Despite the breadth of the antioxidant literature, highly effective antioxidants for lubricating compositions, particularly crankcase lubricants, in which the proportion of metal containing antioxidants can, if desired, be kept low, are still needed.

SUMMARY OF THE INVENTION

Surprisingly, use of three antioxidant components in accordance with the present invention gives antioxidant activity far in excess of the activity of the individual components alone or of any two of the components. The lubricant of the present invention is suitable for use in engine crankcases and comprises a major amount of a lubricating oil, added copper present in oil-soluble form, at least 2 ppm of molybdenum present in oil-soluble form, and a total of from 0.05 to 2 mass % of one or more oil soluble aromatic amines. The method of the present invention comprises using the lubricant in an engine crankcase.

All proportions given in this specification are based on the total mass of the final composition or concentrate, including the mass of any additional constituents not specifically discussed.

The term "added copper" is intended to exclude copper present in the oil as a result of accumulation of copper in the oil during use, for example, as the result of wear or corrosion of copper-containing parts.

The added copper and molybdenum are both present in oil-soluble form. The term "oil-soluble form" does not require solubility in oil in all proportions; rather the component is in oil-soluble form if it is soluble to an extent sufficient to have its intended effect in the environment where the lubricant is to be employed. The component is also in oil-soluble form when it is colloidally dispersible to an extent sufficient to have its intended effect in the environment where the lubricant is to be employed. Oil-soluble form may be achieved by resort to solubility aids. Inclusion of additional additives may also promote the solution or dispersion of the component.

The amount of added copper in the lubricant of the present invention is conveniently from 2 to 500 ppm. Preferably the amount of added copper is not more that 200 ppm. Especially preferred are amounts of added copper in the range of 2 to 50 ppm. The added copper may be an oil-soluble copper salt. Oil-soluble copper salts of $C_8$ to $C_{18}$ fatty acids, unsaturated carboxylic acids, naphthenic acids having molecular weights of from 200 to 500, or alkyl- or alkenyl-substituted dicarboxylic acids are conveniently used. The added copper may also be an oil-soluble copper dithiocarbamate of the general formula $(RR'NCSS)_nCu$ where n is 1 or 2 and each of R and R', which may be the same or different, represents a hydrocarbyl radical containing 1 to 18 carbon atoms. Alternatively the added copper may be an oil-soluble copper sulphonate, phenate, or acetylacetonate.

The amount of molybdenum may conveniently be kept to not more than 500, and preferably 100, ppm. Molybdenum added in an amount ranging from 5 to 50 ppm is most preferred. The molybdenum is preferably added in the form of an oil-soluble molybdenum carboxylate. Preferably the ratio of oil-soluble copper to oil-soluble molybdenum is in the range of 10:1 to 1:10.

The aromatic amine, or (when a mixture of aromatic amines is used) any one of the aromatic amines, may conveniently have one or more alkyl substituents on the amine or on the aromatic ring. The amine may be a diphenylamine, preferably an alkylated diphenylamine. The aromatic amine may constitute from 0.1 to 1 mass percent.

The lubricant of the present invention may also contain one or more ashless dispersant compound(s), one or more nitrogen- or ester containing viscosity index improver dispersant, or a mixture of dispersant and viscosity improver dispersant. The ashless dispersant may conveniently be used in an amount ranging from 1 to 10 mass percent. The nitrogen- or ester-containing viscosity index improver(s) may conveniently be used in an amount ranging for 0.3 to 10 mass percent.

The lubricant may further contain one or more metal detergent inhibitors (e.g. from 2 to 800 ppm calcium or magnesium, conveniently from 500 to 500 ppm calcium or magnesium in the form of basic calcium sulfonate or basic magnesium sulfonate).

The concentrate of the present invention comprises from 10 ppm to 30 mass % added copper present in oil-soluble form; from 10 ppm to 30 mass % molybdenum present in oil-soluble form; and from 2 to 95 mass % of one or more oil-soluble aromatic amines. The concentrate may further include from 0 to 60 mass % ashless dispersant, from 0 to 40 mass % polymeric viscosity improver dispersant, or both. From 0.01 to 8 mass % calcium or magnesium may be included.

Additional components that may be included in the lubricating composition or the concentrate are rust inhibitors, pour point depressants, antiwear agents, additional antioxidants, and viscosity index improvers.

The invention further provides the use as an antioxidant for a crankcase lubricant composition of added copper present in oil-soluble form, at least 2 ppm of molybdenum present in oil-soluble form, and a total of from 0.05 to 2 mass % of one or more oil-soluble aromatic amines.

Surprisingly the use of this three-component antioxidant system results in high antioxidant activity even when only low levels of metal are added (although the use of higher levels of metal is not excluded). Thus, for example, the invention may be advantageous in applications permitting only low copper levels. Systems containing four or more antioxidant components (where the copper/molybdenum/amine system is used with an additional antioxidant) may also give excellent oxidation control.

As will be shown below, the antioxidant systems of the invention have a synergistic effect such that the systems have a degree of antioxidant activity significantly greater than the activity predicted by adding the antioxidant activities of the individual components.

DETAILED DESCRIPTION

A. Lubricating Oil

The lubricating oil component of the present invention may be selected from any of the synthetic or natural oils used as crankcase lubricating oils for spark-ignited and compression-ignited internal combustion engines, for example, automobile and truck engines, marine, and railroad diesel engines. Also be useful are base oils used as aviation lubricants or as lubricants for two cycle engines.

Synthetic base oils include alkyl esters of dicarboxylic acids, polyglycols and alcohols; poly-α-olefins, including polybutenes; alkyl benzenes; organic esters of phosphoric acids; and polysilicone oils.

Natural base oils include mineral lubricating oils which may vary widely as to their crude source, e.g., as to whether they are paraffinic, naphthenic, or mixed paraffinic-naphthenic, as well as to features used in their production, for example, as to the distillation range chosen, and as to whether they are, for example, straight run or cracked, hydrofined, or solvent extracted.

More specifically, natural lubricating oil base stocks which can be used may be straight mineral lubricating oil or distillates derived from paraffinic, naphthenic, asphaltic, or mixed base crude oils.

Alternatively, if desired, various blended oils may be employed as well as residual oils, particularly those from which asphaltic constituents have been removed. The oils may be refined by any suitable method, for example, using acid, alkali, or clay or other agents such, for example, as aluminum chloride, or they may be extracted oils produced by solvent extraction with solvents such as N-methylpyrrolidinone, phenol, sulphur dioxide, furfural, dichlorodiethyl ether, nitrobenzene, or crotonaldehyde.

The lubricating oil base stock conveniently has a viscosity of about 2.5 to about 12 cSt or $mm^2/s$ and preferably about 2.5 to about 9 cSt or $mm^2/s$ at 100° C. Mixtures of synthetic and natural base oils may be used if desired.

B. Added Copper Present In Oil Soluble Form

As indicated earlier, the compositions of the invention contain added copper in oil-soluble form. The amount of added copper in the compositions of the invention is preferably at least 2 ppm. The amount of added copper advantageously does not exceed 500 ppm, and preferably does not exceed 200 ppm. Especially advantageous compositions have copper in the range of from 2 to 100 ppm, preferably 2 to 50 ppm, particularly 2 to 20 ppm and especially 2 to 10 ppm, for example 5 to 10 ppm.

The added copper is advantageously in the form of an oil-soluble copper compound. The copper compound may be in cuprous or cupric form. Examples of suitable oil-soluble copper compounds include the oil-soluble copper compounds mentioned in European Patent Specifications Nos. 24 146 B, 280 579 A and 280 580 A, the disclosures of all of which are incorporated herein by reference. Thus, for example, the added copper may be blended into the oil as an oil-soluble copper salt of a synthetic or natural carboxylic acid. Examples of carboxylic acids from which suitable copper salts may be derived include $C_2$ to $C_{18}$ fatty acids (e.g., acetic acid, stearic acid and palmitic acid), unsaturated acids (e.g., oleic acid), branched carboxylic acids (e.g., naphthenic acids of molecular weight of from 200 to 500, neodecanoic acid and 2-ethylhexanoic acid), and alkyl-or alkenyl-substituted dicarboxylic acids (e.g., polyalkenyl-substituted succinic acids such as octadecenyl succinic acids, dodecenyl succinic acids and polyisobutenyl succinic acids). In some cases, suitable compounds may be derived from an acid anhydride, for example, from a substituted succinic anhydride.

Examples of copper compounds derived from polyalkenyl-substituted succinic acids or anhydrides are copper salts derived from polyisobutenyl succinic anhydride and copper salts of polyisobutenyl succinic acid. Preferably, the copper is in its cupric divalent from, $Cu^{II}$. The preferred acids are polyalkenyl succinic acids in which the alkenyl group has a number average molecular weight (Mn) greater than about 700. The alkenyl group desirably has a Mn from about 900 to 1,400, and up to 2,500, with a Mn of about 950 being most preferred.

The added copper may be blended into the oil as a copper dithiocarbamate of the general formula $(RR'NCSS)_nCu$ or a copper dithiophosphate of the general formula $[(RO)R'O)P(S)S]_nCu$, where "n" is 1 or 2 and each of R and R', which may be the same or different, represents a hydrocarbyl radical containing 1 to 18, preferably 2 to 12 carbon atoms, for example, an alkyl, alkenyl, aryl, aralkyl, alkaryl, or cycloalkyl radical. Other copper- and sulphur-containing compounds, for example, copper mercaptides, xanthates and thioxanthates, are also suitable for use in accordance with the invention, as are copper sulphonates, (optionally sulphurized) phenates and acetylacetonates.

Other copper compounds which may be used in accordance with the invention are overbased copper compounds. Examples of such compounds, and of processes for their preparation, are given in U.S. Pat. No. 4,664,822 and European Specification No. 0 425 367 A, the disclosures of both of which are incorporated herein by reference. In the preparative processes described in the U.S. specification, the copper is used in an essentially oil-insoluble form, for example as the chloride, sulphate or $C_1$ to $C_6$ carboxylate, but in the overbased product the copper is incorporated into the colloidally dispersed material in such a way that the product can act as an antioxidant for a lubricating composition. The European specification describes the use of copper $C_7$ to $C_{10}$ carboxylates which are partially soluble in hydrocarbons so that in the overbased product they are situated at the interface of the base oil and colloidally dispersed micelles. The copper-containing overbased products have an antioxidant effect when the used in lubricating oils.

The added copper may be introduced into the oil in an oil-insoluble form provided that in the finished lubricating composition the copper is in oil-soluble form.

C. Molybdenum Compound

As indicated earlier, the compositions of the invention contain at least 2 ppm of molybdenum present in oil-soluble form. The proportion of molybdenum advantageously does not exceed 500 ppm, and preferably does not exceed 200 ppm. Especially preferred compositions have proportions of molybdenum in the range of from 2 to 100 ppm, particularly 5 to 50 ppm, especially 5 to 20 ppm, for example, 10 to 20 ppm.

The molybdenum is present in the composition in oil-soluble form. As indicated above for the copper, the molybdenum may be incorporated in the composition in the form of any oil-soluble or oil-insoluble compound, provided that in the final composition it is present in oil-soluble form.

The molybdenum may be used in any available oxidation state. The molybdenum may be present as a cation, but this is not essential. Thus, for example, molybdenum-containing complexes may be used.

Examples of molybdenum compounds which may be used include the molybdenum salts of inorganic and organic acids (see, for example, U.S. Pat. No. 4,705,641), particularly molybdenum salts of monocarboxylic acids having from 1 to 50, preferably 8 to 18, carbon atoms, for example, molybdenum octoate (2-ethyl hexanoate), naphthenate or stearate; the reaction product of molybdenum trioxide, molybdic acid or an alkali metal salt thereof (or the reaction product of such a molybdenum compound and a reducing agent) and a secondary amine having hydrocarbon groups having 6 to 24 carbon atoms (see European Specification No. 205 165 B); overbased molybdenum-containing complexes as disclosed in European Specification No. 404 650 A; molybdenum dithiocarbamates and molybdenum dithiophosphates; oil-soluble molybdenum compounds as disclosed in U.S. Pat. Nos. 4,995,996 and 4,966,719, particularly the molybdenum xanthates and thioxanthates claimed in those specifications; and oil-soluble molybdenum- and sulphur-containing complexes. Specific examples of molybdenum- and sulphur-containing complexes are those prepared by reacting an acidic molybdenum compound with a basic nitrogen-containing substance and then with a sulphur source (see, for example, British Specification No. 2 097 422), and those prepared by reacting a triglyceride with a basic nitrogen compound to form a reaction product, reacting the reaction product with an acidic molybdenum compound to form an intermediate reaction product, and reacting the intermediate reaction product with a sulphur-containing compound (see, for example, British Specification No. 2 220 954 A). The disclosures of all the specifications referred to in this paragraph are incorporated herein by reference.

The mass ratio of added copper to molybdenum in the compositions of the invention is advantageously in the range of from 10:1 to 1:10, preferably 5:1 to 1:5, and especially 2:1 to 1:2.

D. Aromatic Amines

As indicated earlier, the compositions of the invention contain a total of from 0.05 to 2 mass preferably 0.1 to 1 mass %, and especially 0.1 to 0.5 mass %, of one or more oil-soluble aromatic amines. A mixture of amines may be used if desired. In determining the proportion of amine, the mass of any diluent oil added with the amine should be ignored; that is, the proportions of amine given herein are "active ingredient" proportions.

Aromatic amines for use in the invention have at least one aromatic group directly attached to at least one amine nitrogen atom. Secondary aromatic amines, especially those having two aromatic groups attached to the same amine nitrogen atom, are preferred, but the use of other aromatic amines is not excluded. The aromatic amine preferably has antioxidant properties in crankcase oils, even in the absence of the copper and molybdenum compounds used in accordance with the invention.

The aromatic groups advantageously contain from 6 to 16 carbon atoms. The amines may contain one or more aromatic groups, for example at least two aromatic groups. Where there are two aromatic groups both are preferably bonded directly to the same amine nitrogen. Compounds in which two aromatic groups are linked by a covalent bond or by an atom or group (e.g., an oxygen or sulphur atom, or a —CO—, —$SO_2$— or alkylene group) may also be used. Aromatic rings, which are preferably aromatic hydrocarbon rings, may be unsubstituted or substituted by one or more substituents selected from alkyl, cycloalkyl, alkoxy, aryloxy, acyl, acylamino, hydroxy, and nitro groups. Amines containing alkyl-substituted aromatic hydrocarbon rings are preferred, especially those containing two alkyl-substituted phenyl groups.

Other atoms or groups which may be bonded to the or each amine nitrogen atom in the aromatic amines include hydrogen atoms and alkyl and aralkyl groups; such alkyl and aralkyl groups may optionally be substituted, for example, by one or more groups selected from hydroxyl, alkyl, and alkoxy groups.

Examples of aromatic amines which may be used in accordance with the invention are amines of the formula

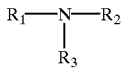

Wherein $R_1$, and $R_2$, which may be the same or different, each represents a hydrogen atom, an alkyl group having 1 to 18 carbon atoms, an aryl group having 6 to 14 carbon atoms, an alkaryl group having from 7 to 34 carbon atoms, or an aralkyl group having from 7 to 12 carbon atoms, and wherein $R_3$ represents an aryl group having from 6 to 14 carbon atoms or an alkaryl group having from 7 to 34 carbon atoms. Each of the alkyl, aryl, alkaryl and aralkyl groups mentioned in the definitions of $R_1$, $R_2$, and $R_3$ may be substituted by one or more substituents selected from alkyl, cycloalkyl, alkoxy, aryloxy, acyl, acylamino, hydroxy, and nitro groups.

Preferred N-aryl amines for use in accordance with the invention are naphthylamines and, especially, diphenylamines, including substituted diphenylamines, particularly diphenylamines of the formula:

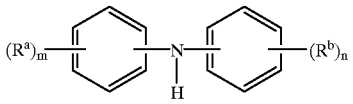

wherein $R^a$ and $R^b$, which may be the same or different, each represents an alkyl group having 1 to 28 carbon atoms, and m and n represent 0, 1 or 2.

Aromatic diamines may also be used. Suitable aromatic diamines include those of the formula:

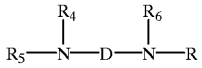

In which $R_4$, $R_5$, $R_6$ and $R_7$ represent the same or different radicals and each represents a hydrogen atom; an alkyl group having from 1 to 12 carbon atoms; or an aryl, alkaryl or aralkyl group each having from 6 to 22 carbon atoms; and D represents an arylene group containing 6 to 14 carbon atoms or a group of the formula:

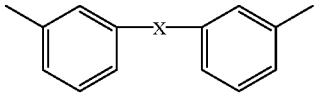

wherein X represents a covalent bond (so that the rings are joined directly to each other via a single bond),an alkylene group containing 1 to 8 carbon atoms, a —CO— or —$SO_2$— group or —O— or —S—. D may be unsubstituted or may contain one or more substituents selected from, for example, alkyl and alkoxyl groups.

E. Additional Additives and Formulations

Additional additives may be incorporated into the compositions of the invention. Examples of such additives are dispersants, viscosity modifiers, detergents and metal rust inhibitors, corrosion inhibitors, other antioxidants, anti-wear agents, friction modifiers, anti-foaming agents, pour point depressants, and rust inhibitors.

The lubricating compositions preferably includes a dispersant, a viscosity modifier dispersant or both a dispersant and a viscosity modifier dispersant. Thus, for example, the compositions advantageously also comprise:

(A) a total of from 1 to 10 mass % of one or more ashless dispersant compounds; or (B) a total of 0.3 to 10 mass % of one or more nitrogen- or ester-containing viscosity modifier dispersants; or (C) a mixture of an ashless dispersant compound and a viscosity modifier dispersant.

Dispersants maintain in suspension oil-insoluble substances that result upon degradation of the lubricating composition. They thereby prevent sludge formation as well as its precipitation or deposition on metal parts. So-called ashless dispersants are organic materials which form substantially no ash on combustion. Suitable dispersants include derivatives of long chain hydrocarbon-substituted carboxylic acids in which the hydrocarbon groups contain 50 to 400 carbon atoms, e.g., derivatives of high molecular weight hydrocarbyl-substituted succinic acid. Such hydrocarbon-substituted carboxylic acids may be reacted with, for example, a nitrogen-containing compound, advantageously a polyalkylene polyamine, or with an ester. Such nitrogen-containing and ester dispersants are well known in the art.

Particularly preferred dispersants are the reaction products of polyallylene amines with alkenyl succinic anhydrides.

In general, suitable dispersants include oil soluble salts, amides, imides, oxazolines, and esters, or mixtures thereof, of long chain hydrocarbon-substituted mono and dicarboxylic acids or their anhydrides; long chain aliphatic hydrocarbons having a polyamine attached directly thereto; and Mannich condensation products formed by condensing about 1 molar proportion of a long chain substituted phenol with about 1 to 2.5 moles of formaldehyde and about 0.5 to 2 moles of a polyalkylene polyamine. In these dispersants long chain hydrocarbon groups are suitably derived from polymers of a $C_2$ to $C_5$ monoolefin, the polymers typically having a number average molecular weight of from 700 to 5000.

Viscosity modifiers (or viscosity index improvers) impart high and low temperature operability to a lubricating oil so that it remains shear stable at elevated temperatures and also exhibits acceptable viscosity or fluidity at low temperatures. Suitable compounds for use as viscosity modifiers are generally high molecular weight hydrocarbon polymers, including polyesters, and viscosity modifier dispersants, which function as dispersants as well as viscosity modifiers. Oil soluble viscosity modifying polymers generally have weight average molecular weights of from about 10,000 to 1,000,000, preferably 20,000 to 500,000, as determined by gel permeation chromatography or light scattering methods.

Representative examples of suitable viscosity modifiers are polyisobutylene, copolymers of ethylene and propylene, polymethacrylates, methacrylate copolymers, copolymers of an unsaturated dicarboxylic acid and a vinyl compound, interpolymers of styrene and acrylic esters, and partially hydrogenated copolymers of styrene/ isoprene, styrene/ butadiene, and isoprene/butadiene, as well as the partially hydrogenated homopolymers of butadiene and isoprene.

As indicated above, a viscosity modifier dispersant functions both as a viscosity modifier and as a dispersant. Examples of viscosity modifier dispersants suitable for use in accordance with the invention include reaction products of amines, for example polyamines, with a hydrocarbyl-substituted mono or dicarboxylic acid in which the hydrocarbyl substituent comprises a chain of sufficient length to impart viscosity modifying properties to the compounds. In general, the viscosity modifier dispersant may be a polymer of a $C_4$ to $C_{24}$ unsaturated ester of vinyl alcohol or a $C_3$ to $C_{10}$ unsaturated mono-carboxylic acid or a $C_4$ to $C_{10}$ di-carboxylic acid with an unsaturated nitrogen-containing monomer having 4 to 20 carbon atoms; a polymer of a $C_2$ to $C_{20}$ olefin with an unsaturated $C_3$ to $C_{10}$ mono- or di-carboxylic acid neutralised with an amine, hydroxyamine or an alcohol; or a polymer of ethylene with a $C_3$ to $C_{20}$ olefin further reacted either by grafting a $C_4$ to $C_{20}$ unsaturated nitrogen-containing monomer thereon or by grafting an unsaturated acid onto the polymer backbone and then reacting carboxylic acid groups of the grafted acid with an amine, hydroxy amine, or alcohol.

Further examples of dispersants and viscosity modifier dispersants which may be used in accordance with the invention may be found in European Patent Specification No. 24146 B referred to above.

Detergents and metal rust inhibitors include, for example, oil-soluble neutral and overbased sulphonates, phenates, sulphurized phenates, thiophosphonates, salicylates, and naphthenates and other oil-soluble carboxylates of a metal, particularly the alkali or alkaline earth metals, e.g., sodium, lithium, calcium, barium and magnesium. The most commonly used metals are calcium and magnesium, mixtures of calcium and magnesium, and mixtures of calcium, magnesium or both with sodium. Overbased detergents function both as detergents and acid neutralizers, thereby reducing wear and corrosion and extending engine life.

The compositions advantageously also comprises a total of from 2 to 8000 ppm of calcium, magnesium, or both. It preferably comprises from 500 to 5000 ppm of calcium, magnesium or both as a basic calcium sulphonate detergent or a basic magnesium sulphonate detergent.

Corrosion inhibitors, also known as anti-corrosive agents, reduce the degradation of metallic parts contacted by the lubricating oil composition.

In accordance with the invention, the use of a supplementary antioxidant is not normally necessary. A supplementary antioxidant may however be used. Examples of supplementary antioxidants include antioxidants mentioned earlier in this specification. Suitable supplementary antioxidants include, for example, other aromatic amines, for example alkylated phenylamines and phenyl $\alpha$-napthylamine; hindered phenols; alkaline earth metal salts of sulphurized alkyl-phenols having preferably $C_5$ to $C_{12}$ alkyl side chains, e.g., calcium nonylphenyl sulphide; barium octylphenyl sulphide; phosphosulphurized or sulphurized hydrocarbons; and other oil-soluble copper compounds, for example those mentioned earlier in this specification. Thus the compositions may comprise, for example, 0.01 to 5 mass % of one or more other lubricant antioxidants, particularly one or more ZDDPs or sulphurized alkyl phenols.

Antiwear agents include zinc dihydrocarbyl dithiophosphates (ZDDPs). Especially preferred ZDDPs for use in oil-based compositions are those of the formula $Zn[SP(S)(OR)(OR')]_2$ wherein R and R' may be the same or different hydrocarbyl radicals containing from 1 to 18, and preferably 2 to 12, carbon atoms, for example, alkyl, alkenyl, aryl, aralkyl, alkaryl and cycloaliphatic radicals. Particularly preferred as R and R' radicals are alkyl radicals having 2 to 8 carbon atoms. Examples of radicals which R and R' may represent are ethyl, n-propyl, i-propyl, n-butyl, i-butyl, sec-butyl, amyl, n-hexyl, i-hexyl, i-heptyl, i-octyl, i-decyl, dodecyl, octadecyl, 2-ethylhexyl, nonylphenyl, dodecylphenyl, cyclohexyl and methylcyclopentyl radicals. In order to obtain oil solubility, the total number of carbon atoms in R and R' will generally be about 5 or greater.

Friction modifiers and fuel economy agents which are compatible with the other ingredients of the final oil may also be included. Examples of such materials are partial esters of glycerol and higher fatty acids, for example, glycerol mono- and di-oleates; esters of long chain polycarboxylic acids with diols, for example, the butane diol ester of a dimerized unsaturated fatty acid; oxazoline compounds; and alkoxylated alkyl-substituted mono-amines, diamines and alkyl ether amines, for example, ethoxylated tallow amine, ethoxylated tallow ether amine, and the like.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, and polymethacrylates.

Foam control can be provided by an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and need not be further elaborated herein.

When lubricating compositions contain one or more of the above-mentioned additives, each additive is typically blended into the base oil in an amount which enables the additive to provide its desired function. Representative effective amounts of such additives, when used in crankcase lubricants, are as follows:

| Additive | Mass % a.i.* (Broad) | Mass % a.i.* (Preferred) |
|---|---|---|
| Dispersant | 0.1–20 | 0.1–8 |
| Detergents/Rust inhibitors | 0.01–6 | 0.01–4 |
| Viscosity Modifier | 0.01–6 | 0.01–4 |
| Corrosion Inhibitor | 0.01–5 | 0.01–1.5 |
| Oxidation Inhibitor | 0.01–5 | 0.01–1.5 |
| Pour Point Depressant | 0.01–5 | 0.01–1.5 |
| Anti-Foaming Agent | 0.001–3 | 0.001–0.15 |
| Anti-wear Agents | 0.01–6 | 0.01–4 |
| Friction Modifier | 0.01–5 | 0.01–1.5 |
| Mineral or Synthetic Base Oil | Balance | Balance |

*Mass % active ingredient based on the final oil.

The components of the antioxidant system used in accordance with the invention may be incorporated into a base oil in any convenient way. Thus, each of the components can be added directly to the oil by dispersing or dissolving it in the oil at the desired level of concentration. Such blending may occur at ambient temperature or at an elevated temperature.

The components of the antioxidant system may be incorporated individually into the base oil, or any two, or all, of the components may be incorporated together. Where all the components are added together they are conveniently added in the form of a concentrate comprising an oil solution containing (1) from 10 ppm to 30 mass %, advantageously 10 ppm to 5 mass %, of added copper present in oil-soluble form;

(2) from 10 ppm to 30 mass %, advantageously 10 ppm to 5 mass %, of molybdenum present in oil-soluble form; and (3) from 2 to 95 mass % of one or more oil soluble aromatic amines.

Such a concentrate advantageously also comprises (A) from 0 to 60 mass % of an ashless dispersant, or from 0 to 40 mass % of a polymeric viscosity index improver dispersant (although such a viscosity index improver dispersant would normally be added separately), and (B) a total of from 0.01 to 8 mass % of calcium, magnesium, or both. The concentrate may also contain a total of from 0 to 60 mass % of one or more zinc dihydrocarbyl dithiophosphates.

Such a concentrate could be prepared in a number of parts which are added separately to the base oil. Thus, for example, the copper and molybdenum could be present in one part, and the aromatic amine and the other additives in another part.

As indicated earlier, when a plurality of additives is employed, one or more additive concentrates comprising the additives (concentrates sometimes being referred to herein as additive packages) may be prepared whereby several additives can be added simultaneously to the base oil to form the lubricating oil composition. Blending of the additive concentrate(s) into the lubricating oil may be facilitated, for example, by mixing with heating, but this is not essential. The concentrate(s) or additive package(s) will typically be formulated to contain the additive(s) in proper amounts to provide the desired concentration in the final formulation when the additive package(s) is (or are) combined with a predetermined amount of base lubricant. Thus, the components of the antioxidant system used in accordance with the present invention can be added to small amounts of base oil or other compatible solvents along with other desirable additives to form one or more additive packages containing active ingredients in an amount, based on the additive package, of from about 2.5 to about 90 mass %, and preferably from about 5 to about 75 mass %, and most preferably from about 8 to about 50 mass % by weight, additives in the appropriate proportions with the remainder being base oil.

The final formulations may employ typically about 10 mass % of the additive package(s) with the remainder being base oil.

The following Examples illustrate the invention. In the Examples, all proportions of constituents are active ingredient proportions by mass, calculated on the mass of the total composition, unless otherwise specified. The proportions of copper are those calculated on the basis of the proportion of the copper-containing additive used and its copper content.

EXAMPLE 1

A formulated lubricating composition having only ZDDP as an antioxidant was tested with each component of the three copper/molybdenum/amine antioxidant system of the present invention and with each possible pair of the components. Finally, the same formulation was tested with the fill three component system.

A test known as the ERCOT test was used. That test is designed to simulate the oxidative, iron-catalysed environment of an internal combustion engine. In the ERCOT test, a test sample containing ferric acetylacetonate giving 40 ppm iron as catalyst is oxidized by passing air through the composition at elevated temperature, and the viscosity is determined at intervals using a Haake viscometer. A plot of the results obtained is used to estimate the time elapsing before a 200% increase in viscosity took place.

The control formulation having only ZDDP as an antioxidant included:

| | mass % |
|---|---|
| Ashless dispersant | 3.2% |
| 400 TBN calcium sulphonate detergent | 1.5% |
| ZDDP | 1.1% |
| Diluent oil | 94.2% |

The aromatic amine tested was di(nonyl-substituted phenyl)amine (available commercially, for example as Naugalube 438L from Uniroyal Chemical company). The oil-soluble copper compound was cupric oleate. The oil-soluble molybdenum compound was molybdenum (II) 2-ethylhexanoate. These compounds were added to give the proportions of amine, copper and molybdenum given in Table 1. Table 1 also shows the "Hours increase" for each test formulations which compares the oxidation susceptibility of test formulation to that of the control formulation. The "hour increase" figure is obtained by subtracting from the time elapsed when the viscosity increase of the test formulation reached 200% the time elapsed when the viscosity increase of the control formulation reached 200%.

TABLE 1

| Test No. | Amine (mass %) | Copper (ppm) | Molybdenum (ppm) | Hours increase |
|---|---|---|---|---|
| 1 (Control) | — | — | — | 0 |
| 2 (amine only) | 0.3 | — | — | 14 |
| 3 (added copper only) | — | 40 | — | 5 |
| 4 (molybdenum only) | — | — | 40 | −3 |
| 5 (added copper + molybdenum) | — | 40 | 40 | 5 |
| 6 (amine + added copper) | 0.3 | 40 | — | 21 |
| 7 (amine + molybdenum) | 0.3 | — | 40 | 7 |
| 8 (amine, added copper + molybdenum | 0.3 | 40 | 40 | 28 |

The results show that the three component anti-oxidant system of the present invention gives an oxidation inhibition greater than that predictable from the results obtained for the individual components, or combinations of two of the components.

EXAMPLE 2

The formulations tested in Example 1 had relatively low proportions of copper and molybdenum (40 ppm). Formulations containing even lower proportions of copper and molybdenum, and, in some cases, lower proportions of amine were also tested. In each case, the amine, copper compound, molybdenum compound and control formulation were the same as in Example 1. The results obtained are given in Table 2, the "Hours increase" being calculated in the same manner as in Example 1:

TABLE 2

| Test No. | Amine (mass %) | Added Copper (ppm) | Molybdenum (pprn) | Hours increase |
|---|---|---|---|---|
| 9 | 0.3 | 20 | 20 | 29 |
| 10 | 0.3 | 20 | 10 | 29 |
| 11 | 0.3 | 10 | 20 | 29 |
| 12 | 0.3 | 10 | 10 | 24 |
| 13 | 0.3 | 5 | 20 | 32 |
| 14 | 0.3 | 5 | 10 | 26 |
| 15 | 0.3 | 2 | 20 | 35 |
| 16 | 0.3 | 2 | 10 | 31 |
| 17 | 0.3 | 4.5 | 6.5 | 26 |
| 18 | 0.2 | 2 | 20 | 22 |
| 19 | 0.2 | 6 | 10 | 16 |

These results show that with 0.3 mass % amine extremely good results were obtained even with very low proportions of copper and/or molybdenum. Even when using a lower proportion of amine (0.2 mass %), good results were obtained with low proportions of copper and amine. A similar result (at least 28 hours increase) to that indicated in Table 2 for formulation 14 was obtained when adding the proportions of amine, copper and molybdenum used in formulation 14 to a base formulation identical to that used above except that it contained only half the amount of ZDDP, and subtracting from the "time to 200% viscosity increase" the corresponding time obtained when testing the modified base formulation alone.

EXAMPLE 3

Certain of the formulations specified in Example 2, and a comparison formulation (using the same amine and copper compound) were tested under isothermal conditions using a Differential Scanning Calorimeter (DSC) oxidation test, which is widely used in the industry as a guide to the performance of lubricants in engine tests. In the DSC test, the period during which oxidation of a sample under oxygen pressure is inhibited is measured using a differential scanning calorimeter. In the DSC oxidation test the compounds to be evaluated as antioxidants were added at the treat rates shown in table 3 to a sample of the control formulation. The test sample (6–9 mg) was placed in the center of an aluminum DSC pan and inserted into a DuPont 990 High Pressure DSC instrument. The cell of the DSC was then purged three times with 100 psi $O_2$ and then filled with $O_2$ at 250 psi. The cell was then heated at a programmed ramped rate of 100° C./min to the isothermal temperature of 190° C. After a period of time the test sample undergoes an exothermic oxidative reaction; this event and magnitude of the associated heat effects compared to the inert reference are monitored and recorded. The oxidation induction time (OIT; time to auto-oxidation) is the time at which the baseline intersects with a line tangent to the curve of the exothermal heat flow versus time scan. The OIT is reported in minutes. The magnitude of the OIT is an indication of the effectiveness of the compounds or compound mixtures under test as antioxidants; the larger the OIT the greater the antioxidant effect. The results obtained are given in Table 3:

TABLE 3

| Test No | Amine (mass %) | Added Copper (ppm) | molybdenum (ppm) | OIT (mins) |
|---|---|---|---|---|
| 20 (control) | — | — | — | 12 |
| 21 | 0.3 | 4.5 | 6.5 | 46 |
| 22 | 0.2 | 2 | 20 | 47 |
| 23 | 0.2 | 6 | 10 | 44 |
| 24 | 0.2 | 10 | — | 31 |

Formulations containing the three component antioxidant system of the present invention, tests 21, 22 and 23, all gave better results than formulation 24, which contained no molybdenum. Formulations 21 to 24 all gave better results than the control, formulation 20.

EXAMPLE 4

The usefulness of three component antioxidant systems in inhibiting oxidation was also demonstrated in a modification of the DSC oxidation test described in Example 3. In the modified test, the procedure is the same as described above except that 500 ppm iron and 2000 ppm lead were added as catalysts to the test formulation to promote oxidation, so that the figures obtained for the length of time for which oxidation is inhibited are lower than those obtained using the standard DSC oxidation test.

The formulations tested consisted of a control formulation to which di(nonylphenyl)amine, copper (II) polyisobutenyl succinate, and molybdenum 2-ethylhexanoate were added in the proportions indicated in Table 4. The control formulation (test no. 25) contained 2.8 mass % dispersant, 1.5 mass % 400 total base number (TBN) magnesium sulphonate detergent, 0.5 mass % of 25 TBN calcium sulphonate detergent, and 1.3 mass % ZDDP, the balance being diluent oil. The results obtained are given in Table 4.

TABLE 4

| Test No. | Amine (mass %) | Added Copper (ppm) | Mo (ppm) | OIT (min) |
|---|---|---|---|---|
| 25 (control) | 0 | 0 | 0 | 2 |
| 26 | 0.3 | 12.5 | 12.5 | 20 |
| 27 | 0.3 | 50 | 25 | 17 |
| 28 | 0.3 | 4.5 | 6.5 | 27 |

TABLE 4-continued

| Test No. | Amine (mass %) | Added Copper (ppm) | Mo (ppm) | OIT (min) |
|---|---|---|---|---|
| 29 | 0.2 | 2 | 20 | 14 |
| 30 | 0.2 | 6 | 10 | 18 |
| 31 | 0.35 | 2 | 10 | 18 |

EXAMPLE 5

Three-component antioxidant systems of the invention were also tested in an oxidation test in which a catalyst and air are introduced into the lubricating composition to be tested which is then heated and introduced into a heated vessel. The test is designed to simulate the operating conditions of the Sequence IIIE engine test. Samples are taken at intervals and their viscosity measured, the increase in viscosity being an indication of the extent to which oxidation has taken place.

The components of the antioxidant system were added, individually and together, to the control formulation as described in example 4. The amine used was di(nonylphenyl)-amine. Copper was added as copper oleate, and molybdenum as molybdenum 2-ethylhexanoate.

The results obtained are indicated in Table 5

TABLE 5

| Test No | Amine (mass %) | Added copper (PPM) | Molybdenum (PPM) | Per Cent Viscosity Increase After 20 hrs | 24 hrs | 28 hrs | 32 hrs | 38 hrs | 40 hrs | 44 hrs | 46 hrs | 47 hrs | 48 hrs | 52 hrs | 68 hrs | 72 hr |
|---|---|---|---|---|---|---|---|---|---|---|---|---|---|---|---|---|
| 32 | — | — | — | 60 | 87 | 117 | | | | | | | | | | |
| 33 | 0.15 | — | — | 40 | 58 | | | 140 | 158 | 205 | 241 | | | | | |
| 34 | 0.15 | 12.5 | — | 10 | 12 | | | | 40 | | | | 95 | 132 | | |
| 35 | — | 12.5 | 12.5 | | | 37 | 60 | | | | | 204 | | 300 | | |
| 36 | 0.15 | 12.5 | 12.5 | | <0 | | | | | | | | <0 | | <0 | <0 |

EXAMPLE 6

This example shows that the three-component system of the invention has a significant antioxidant action even when a very low proportion of amine is used. A control formulation as described in example 4 was subjected in test 37 to the oxidation test described in Example 5 without an antioxidant system in accordance with the invention. In test 38, the same formulation plus the three component antioxidant of the present invention was tested. The three component antioxidant system comprised 0.1 mass % di(nonylphenyl)amine, and copper oleate and molybdenum 2-ethylhexanoate in amounts to give 16.5 ppm of each of copper and molybdenum (Formulation 32). The results obtained are indicated in Table 6:

TABLE 6

| Test No | Percent Viscosity Increase After 20 hrs | 24 hrs | 28 hrs | 32 hrs | 41 hrs | 46 hrs | 48 hrs |
|---|---|---|---|---|---|---|---|
| 37 | 50 | 85 | 127 | | 524 | | |
| | 38 | 10 | | 19 | | 83 | 101 |

EXAMPLE 7

The control formulation described in example 4 was tested with varying amounts of di(nonylphenyl)amine, copper oleate, and molybdenum 2-ethylhexanoate. In this test the components were added to the control formulation individually and in combination and tested as described in example 5. For each such formulation, the amount of time elapsed before a 375% increase in the viscosity of that formulation took place is shown in Table 7:

TABLE 7

| Test No. | Amine (mass %) | Added Copper (ppm) | Molybdenum (ppm) | Hours to 375% Viscosity increase |
|---|---|---|---|---|
| 39 | — | 50 | — | 35 |
| 40 | — | — | 50 | 37 |
| 41 | — | 25 | 25 | 38 |
| 42 | 0.3 | — | — | 40 |
| 43 | 0.15 | 25 | — | 44 |
| 44 | 0.15 | — | 25 | 52 |
| 45 | 0.1 | 16.5 | 16.5 | 60 |

As can be seen from Table 5, even with a low amount of amine and relatively low amounts of copper and molybdenum, formulation 45 gives significant inhibition of oxidation.

EXAMPLE 8

A lubricating formulation in accordance with the invention (formulation 46) was tested in the Sequence IIIE engine test. The formulation contained 1.9 mass % ashless dispersant, 0.83 mass % ZDDP, 2.3 mass % 300 TBN calcium sulphonate, 0.5 mass % 400 TBN magnesium sulphonate, together with a sulphurized phenolic antioxidant and a multifunctional viscosity modifier. In addition, the formulation contained 0.4 mass % di(nonyl phenyl)amine, and cupric oleate and molybdenum (II) 2-ethylhexanoate in proportions giving 4 ppm copper and 10 ppm molybdenum in the formulation. The results obtained are indicated in Table 6:

TABLE 8

| | |
|---|---|
| viscosity increase at 64 hrs (%) | 148 |
| Average sludge | 9.56 |
| Max. cam and lifter wear ($\mu$m) | 28.0 |
| Average cam and lifter wear ($\mu$m) | 17.7 |
| Average piston skirt varnish | 8.99 |
| Oil ring land deposit | 6.01 |
| Number of stuck rings | 2 |
| Number of stuck lifters | 0 |

The results obtained show that formulation 46 gave excellent results in the Seq. IIIE test.

EXAMPLE 9

Alkylated phenyl $\alpha$-naphthylamine, cupric polyisobutenyl succinate and/or molybdenum dithiocarbamate were added to control formulation 1 as specified in Example 1 to give the proportions of amine, copper and molybdenum specified in Table 9. The resulting compositions were subjected to the ERCOT test described in Example 1. The results obtained, which are shown in Table 9, were compared with those for the control formulation.

TABLE 9

| Formulation No. | Amine (mass %) | Proportions Copper (ppm) | Molybdenum (ppm) | Hours increase |
|---|---|---|---|---|
| 1 (Base) | — | — | — | 0 |
| 50 | — | — | 10 | −3 |
| 51 | 0.5 | 5 | — | 12 |
| 52 | 0.5 | 5 | 10 | 17 |

We claim:

1. A lubricant composition suitable for use as a crankcase lubricant comprising a major amount of a lubricating oil, added copper present in oil soluble form in an amount of from about 2 ppm to about 200 ppm, molybdenum present in oil soluble form in an amount of from about 5 ppm to about 500 ppm, from 0.05 to 2 mass % of one or more oil-soluble aromatic amines and a ZDDP.

2. A composition as claimed in claim 1, wherein the copper is incorporated in the composition as a) an oil-soluble copper salt of a $C_2$ to $C_{18}$ fatty acid, an unsaturated carboxylic acid, a naphthenic acid having a molecular weight from 200 to 500, or an alkyl or alkenyl-substituted dicarboxylic acid, b) an oil-soluble copper dithiocarbamate of the general formula $(RR'NCSS)_nCu$ or oil-soluble copper thiophosphate of the general formula $[(RO)(R'O)P(S)S]_nCu$, where n is 1 or 2 and each of R and R', which may be the same or different, represents a hydrocarbyl radical containing 1 to 18 carbon atoms, or c) an oil-soluble copper sulphonate, phenate or acetylacetonate.

3. A composition as claimed in claim 2, wherein the proportion of aromatic amine is from 0.1 to 1 mass %.

4. A composition as claimed in claim 2, wherein the amine, or at least one of the amines, is a diphenylamine.

5. A composition as claimed in claim 2, wherein the oil-soluble amine component comprises an alkylated diphenylamine.

6. A composition as claimed in claim 2, wherein the ratio of the proportion of oil-soluble copper to the proportion of oil-soluble molybdenum is in the range of from 10:1 to 1:10.

7. A composition as claimed in claim 2, which also comprises one or more additional additives selected from and sulphurized phenols.

8. A composition as claimed in claim 2, which also comprises:

(a) a total from 1 to 10 mass % of one or more ashless dispersant compounds; or (b) a total of 0.3 to 10 mass % of one or more nitrogen- or ester-containing viscosity index improver dispersants, or (c) a mixture of an ashless dispersant compound and one or more nitrogen- or ester-containing viscosity index improver dispersants.

9. A composition as claimed in claim 1, wherein the proportion of molybdenum is from 5 to 50 ppm.

10. A composition as claimed in claim 1, wherein the proportion of aromatic amine is from 0.1 to 1 mass %.

11. A composition as claimed in claim 1, which also comprises one or more additional additives selected from sulphurized phenols.

12. A composition according to claim 1 wherein said molybdenum is present in an amount of from about 5 to about 200 ppm.

13. A composition according to claim 1 wherein said molybdenum is a molybdenum dithiocarbamate.

14. A concentrate comprising an oil solution containing:

(1) from 10 ppm to 30 mass % of copper present in oil soluble form;

(2) from 10 ppm to 30 mass % of molybdenum present in oil-soluble form; and (3) from 2 to 95 mass % of one or more oil soluble aromatic amines and a ZDDP.

15. A concentrate as claimed in claim 14, which also comprises from 0 to 60 mass % of an ashless dispersant, from 0 to 40 mass % of a polymeric viscosity improver dispersant or both.

16. A concentrate as claimed in claim 14 or claim 15, which further comprises a total of from 0.01 to 8 mass % of calcium, magnesium or both.

* * * * *